US007500323B2

(12) United States Patent
Rasmussen

(10) Patent No.: US 7,500,323 B2
(45) Date of Patent: Mar. 10, 2009

(54) ARTICLE OF FOOTWEAR INCLUDING A FASTENING SYSTEM

(75) Inventor: Jeff Rasmussen, Portland, OR (US)

(73) Assignee: Nike, Inc., Beaverton, OR (US)

( * ) Notice: Subject to any disclaimer, the term of this patent is extended or adjusted under 35 U.S.C. 154(b) by 390 days.

(21) Appl. No.: 11/203,821

(22) Filed: Aug. 15, 2005

(65) Prior Publication Data

US 2007/0033836 A1 Feb. 15, 2007

(51) Int. Cl.
*A43C 11/00* (2006.01)

(52) U.S. Cl. ..... 36/50.1

(58) Field of Classification Search ..... 36/50.1, 36/50.5, 58.5

See application file for complete search history.

(56) References Cited

U.S. PATENT DOCUMENTS

| | | | | | |
|---|---|---|---|---|---|
| 1,668,120 | A | * | 5/1928 | McLaren | 36/50.1 |
| 2,717,437 | A | | 9/1955 | DeMestral | |
| 3,952,430 | A | | 4/1976 | Pankin et al. | |
| 4,215,493 | A | * | 8/1980 | Antonious | 36/51 |
| 4,270,285 | A | | 6/1981 | Antonious | |
| 4,275,513 | A | | 6/1981 | Antonious | |
| 4,282,657 | A | | 8/1981 | Antonious | |
| 4,486,965 | A | * | 12/1984 | Friton | 36/50.1 |
| 4,599,811 | A | | 7/1986 | Rousseau | |
| 4,621,648 | A | | 11/1986 | Ivany | |
| 4,640,025 | A | | 2/1987 | DeRenzo | |
| 4,642,914 | A | | 2/1987 | Caldeira | |
| 4,714,096 | A | * | 12/1987 | Guay | 139/391 |
| RE32,585 | E | | 2/1988 | Antonious | |
| 4,751,784 | A | | 6/1988 | Petker et al. | |
| 4,845,864 | A | | 7/1989 | Corliss | |
| 4,872,243 | A | | 10/1989 | Fischer | |
| 4,907,352 | A | | 3/1990 | Ginsberg | |
| 4,969,277 | A | | 11/1990 | Williams | |
| 5,014,448 | A | | 5/1991 | Perrone | |
| 5,015,251 | A | | 5/1991 | Cherubini | |
| 5,176,624 | A | | 1/1993 | Kuehnreich | |
| 5,269,078 | A | * | 12/1993 | Cochrane | 36/93 |
| 5,323,549 | A | * | 6/1994 | Segel et al. | 36/140 |
| 5,659,982 | A | | 8/1997 | Muraoka et al. | |
| 5,699,629 | A | | 12/1997 | Munschy | |
| 5,744,080 | A | | 4/1998 | Kennedy et al. | |
| 5,797,862 | A | | 8/1998 | Lamont | |
| 5,802,676 | A | | 9/1998 | Tolan | |
| 5,992,067 | A | | 11/1999 | Monti | |
| 6,156,001 | A | | 12/2000 | Frangi et al. | |
| 6,212,798 | B1 | | 4/2001 | Koenig et al. | |
| 6,286,233 | B1 | | 9/2001 | Gaither | |
| 6,397,638 | B1 | | 6/2002 | Roell | |
| 6,484,325 | B1 | | 11/2002 | Lazarus et al. | |
| 6,754,983 | B2 | | 6/2004 | Hatfield et al. | |
| 6,842,915 | B2 | | 1/2005 | Turner et al. | |
| 6,857,204 | B1 | * | 2/2005 | Davis et al. | 36/50.1 |
| 2002/0174568 | A1 | | 11/2002 | Neiley | |
| 2003/0029057 | A1 | * | 2/2003 | Suzuki et al. | 36/50.1 |
| 2004/0134100 | A1 | * | 7/2004 | McVicker | 36/50.1 |
| 2005/0016028 | A1 | * | 1/2005 | Safdeye | 36/132 |

* cited by examiner

*Primary Examiner*—Ted Kavanaugh
(74) *Attorney, Agent, or Firm*—Plumsea Law Group, LLC

(57) ABSTRACT

An article of footwear including a fastening system is disclosed. The fastening system is adjustable and includes portions that can be directly attached to the article. The article can be made of a material that is capable of engaging portions of the fastening system. The fastening system can also include portions that are disposed underneath an outer layer.

38 Claims, 10 Drawing Sheets

ARTICLE OF FOOTWEAR INCLUDING A FASTENING SYSTEM

BACKGROUND OF THE INVENTION

1. Field of the Invention

This invention relates to an article of footwear, and more particularly, to a fastening system for an article of footwear.

2. Related Art

Articles of footwear generally include some kind of provision that allows the article to be opened to allow entry of a wearer's foot, and to be closed so that the article is secured to the wearer's foot. In the past, lacing systems have been used. Drawbacks associated with lacing systems are discussed in Friton (U.S. Pat. No. 4,486,965), the entirely of which is incorporated by reference.

The use of alternative fastening systems that do not use laces have also been proposed. In one example, Hatfield et al. (U.S. Pat. No. 6,754,983) discloses an article of footwear with a tented arrangement. Hatfield states that this arrangement helps to facilitate air circulation about the article. In some configurations, Hatfield teaches a foot bootie and an outer shroud. Straps can be disposed between the foot bootie and the outer shroud. Those configurations that use straps, the straps can be used instead of conventional laces.

Generic, hook and loop fasteners, sometimes referred to by the trade name, VELCRO, are generally known. Guay (U.S. Pat. No. 4,714,096) teaches an elastic fabric that includes a loop surface that can be used as the female side of a VELCRO fastener. Guay is a proposed modification of the original hook and loop fastener invented by De Mestral (U.S. Pat. No. 2,717,437). In some cases, hook and loop fasteners have been applied to shoes and other articles of footwear.

Friton (U.S. Pat. No. 4,486,965) discloses an article of footwear with overlapping straps. Friton also teaches the use of cooperating pile and hook fasteners that are attached to the straps and to the upper. Friton states that this arrangement allows the shoe to be opened and closed quickly and helps wearers achieve proper tension quickly.

Corliss (U.S. Pat. No. 4,845,864) teaches a cycling shoe that includes a pair of hook and loop fasteners, one fastener at the instep and one fastener to adjust the fit at the forefoot. The instep fastener includes a fastener strap 56 that includes a hook or pile surface 66. Fastener strap 56 is secured to side panel 30 of the cycling shoe. Corliss also teaches a cinch anchor member 82 that is also secured to side panel 30 with stitching 88. Cinch anchor member 82 engages the free end portion 80 of outer strap 54.

McVicker (U.S. application publication US 2004/0134100 A1) teaches a footwear closure system where the hooks of a hook and loop fastener are integrally molded. The footwear article proposed by McVicker uses a subassembly 10 with integrally molded hooks 18 disposed on lateral flaps 19 of the subassembly 10. Each lateral flap 19 has an associated loop bearing member 20 with a field of loops 29.

Muraoka et al. (U.S. Pat. No. 5,659,982) teaches a tensioning implement 7 that uses hook and loop fastening elements. Tensioning implement 7 includes a fixed end 7*b* and a free end 7*a*. A pair of hook and loop gripping elements is sewn into the opposing faces of the fixed and free ends. This arrangement allows the adjustment of turnover portion 7*c*.

While the related art teaches various forms of fastening systems, there are many shortcomings. Related art fastening systems lack variability and adjustability. Generally, fasteners must be applied. Related art fastening systems can be bulky and are not aesthetically pleasing. This is because virtually all of the fastening system is exposed and hook and loop pads must be attached to the article.

Generally, the devices that use contact fasteners like hook and loop fasteners, can allow some degree of flexibility and adjustability. However, this ability is limited by the size and shape of the contact fastener. Also, shoes using conventional hook and loop fasteners generally have those fasteners attached to the shoe. This arrangement can sometimes look bulky and be unappealing and not very aesthetically pleasing.

Conventional hook and loop arrangements can also increase the complexity of the shoe and thus making manufacturing the shoe more difficult and introducing another device that can fail or break on the shoe. These and other shortcomings indicate a need for a fastening system for an article of footwear that overcomes these problems and can also provide an aesthetically pleasing design.

SUMMARY OF THE INVENTION

A fastening system for an article of footwear is disclosed. In one aspect, the invention provides an article of footwear, comprising a sole; an upper including a first side, a second side, an upper portion including an opening configured to receive a foot, the upper being connected to the sole; a strap associated with the first side and extending over the upper portion; the strap having an inner portion facing towards the article of footwear and an outer portion facing away from the article of footwear; the strap configured to engage the second side; the strap including a first contact fastener material disposed on the inner portion; the upper being made of a second contact fastener material; and where the first contact fastener is configured to engage the second contact fastener.

In another aspect, first side is a lateral side and the second side is a medial side.

In another aspect, the first side is a medial side and the second side is a lateral side.

In another aspect, the upper portion includes an outer layer and a portion of the strap is disposed underneath the outer layer.

In another aspect, a portion of the strap is disposed above the outer layer.

In another aspect, the strap comprises a grasping member and an associated open member.

In another aspect, the grasping member engages the open member and is threaded through an aperture in an outer layer.

In another aspect, the invention provides an article of footwear, comprising a sole; an upper including an opening configured to receive a foot, the upper being connected to the sole; at least one strap having an inner portion facing towards the article of footwear and an outer portion facing away from the article of footwear; the strap configured to engage a portion of the upper; where the strap includes a first contact fastening member; and where the upper includes a second contact fastening member that cooperates with the first contact fastening member.

In another aspect, the upper includes an outer layer made of the second contact fastening member and wherein the strap is configured to engage the outer layer.

In another aspect, the strap is configured to be attached to the outer layer at an attached position.

In another aspect, the attached position can be adjusted in a first direction and also adjusted in a second direction, where the first direction is angled from the second direction.

In another aspect, the attached position can be varied away from an aperture in the upper.

In another aspect, the attached position can be angled with respect to the aperture.

In another aspect, the second contact fastening member is larger in length and width than the first contact fastening member.

In another aspect, the invention provides an article of footwear, comprising a sole; an upper including an opening configured to receive a foot connected to the sole; the upper being made of a material; and where the material is a contact fastener.

In another aspect, the material is a woven flexible fabric.

In another aspect, the material is compatible with a hook and loop fastener.

In another aspect, the material is configured to act as a loop side of a hook and loop fastener.

In another aspect, the material is compatible with a Velcro fastener.

In another aspect, the invention provides an article of footwear comprising a sole; an upper connected to the sole including an opening configured to receive a foot, an inner layer and an outer layer, a fastening system disposed between the inner layer and the outer layer; the fastening system having a first side and a second side and including a first strap system, the first strap system including a first grasping member and a first open member, wherein the first grasping member is threaded through an aperture in the first open member and a central portion of the first grasping member bends around the first open member.

In another aspect, the first grasping member is associated with the first side and the first open member is associated with the second side.

In another aspect, the fastening system includes a second strap system having a second grasping member and a second open member.

In another aspect, the second grasping member is associated with the second side and the second open member is associated with the first side.

In another aspect, the fastening system includes a third strap system having a third grasping member associated with the first side and a third open member associated with the second side; and wherein the second strap system is disposed between the first strap system and the third strap system to provide an alternating pattern of strap systems.

In another aspect, the first grasping member is connected to the second open member.

In another aspect, the first open member is connected to the second grasping member.

In another aspect, the second open member is connected to the third grasping member.

In another aspect, the second grasping member is connected to the third open member.

In another aspect, the second open member is connected to the first grasping member and the third grasping member.

In another aspect, the second grasping member is connected to the first open member and the third open member.

In another aspect, the first strap system is connected to a rear strap system that is disposed about a rear portion of the article of footwear.

In another aspect, the rear strap system includes a rear grasping member and a rear open member.

In another aspect, the rear grasping member is integrally formed with the first strap system and wherein the rear open member is an aperture formed in the first strap system.

In another aspect, the invention provides an article of footwear, comprising a sole; an upper connected to the sole including an opening configured to receive a foot, an inner layer and an outer layer, a fastening system disposed between the inner layer and the outer layer; the fastening system having a rear strap system disposed about a rear portion of the article of footwear; the rear strap system having a portion disposed between the inner layer and the outer layer and a portion disposed outward of the outer layer.

In another aspect, the rear strap system includes a rear grasping member and a rear open member.

In another aspect, the rear grasping member is threaded through an aperture of the rear open member and an exterior hole formed on the outer layer.

In another aspect, the aperture and the exterior hole are aligned.

In another aspect, the rear grasping member emerges from an exterior hole formed on the outer layer and attaches to the outer layer.

In another aspect, the rear grasping member includes a first contact fastener and the outer layer is formed of a second contact fastener configured to cooperate with the first contact fastener.

In another aspect, the rear grasping member extends circumferentially about the rear portion of the article of footwear and applies a hoop stress about the rear portion.

In another aspect, the rear grasping member can be attached to the outer layer in a first location and a second location, wherein the second location is horizontally and vertically spaced from the first location.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENT(S)

Figure 1:
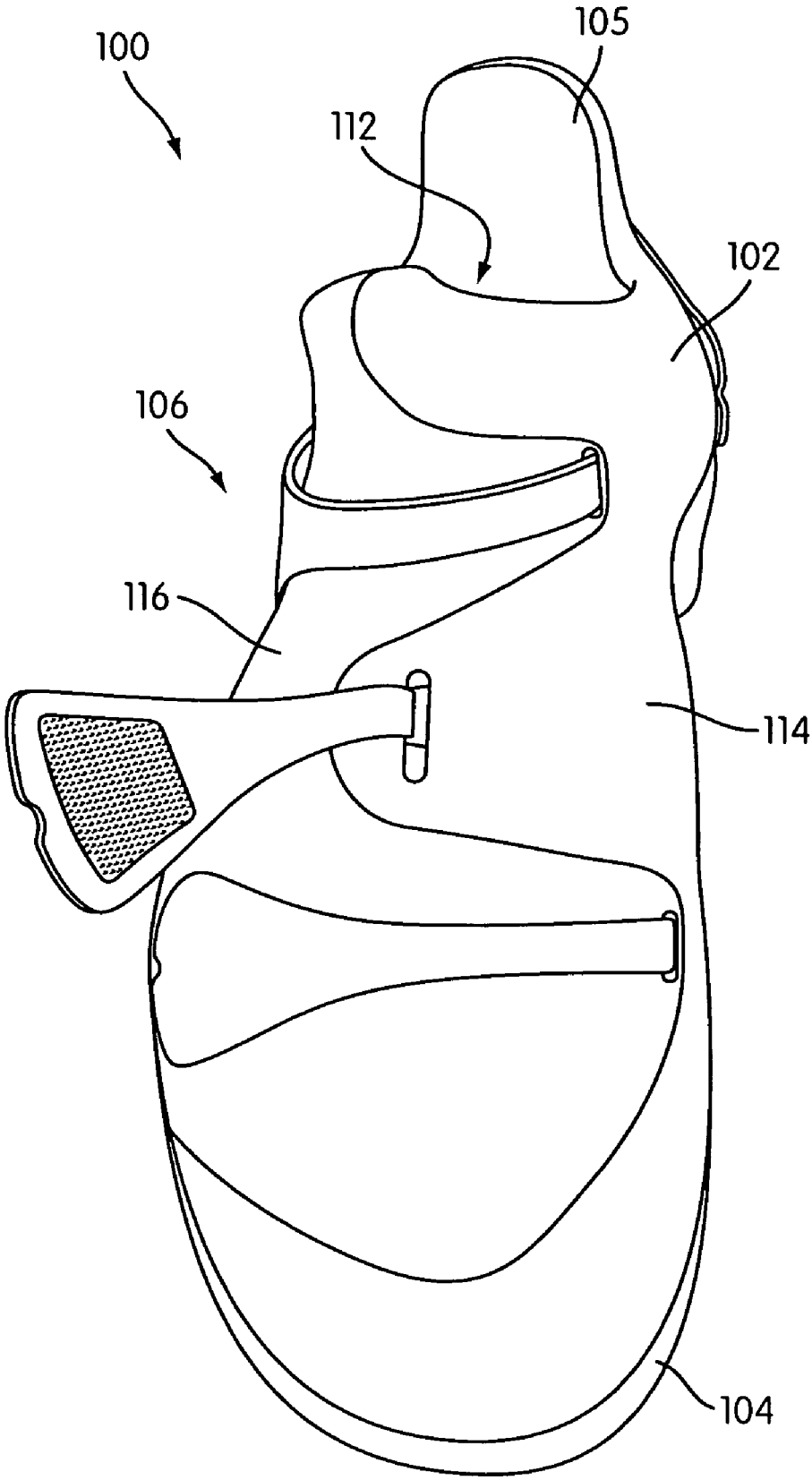
FIG. 1 is a perspective view of a preferred embodiment of an article of footwear.

FIG. 1 is a preferred embodiment of an article of footwear 100 in the form of an athletic shoe. For clarity, the following detailed description discusses a preferred embodiment, however, it should be kept in mind that the present invention could also take the form of any other kind of footwear including, for example, skates, boots, ski boots, snowboarding boots, cycling shoes, formal shoes, slippers, or any other kind of footwear.

Article 100 includes upper 102 and sole 104. Upper 102 includes an entry hole 105 that allows a user's foot to enter upper 102. Preferably, upper 102 is associated with sole 104, and in preferred embodiments, upper 102 is attached to sole 104. In some embodiments, upper 102 is connected to sole 104 by stitching or an adhesive. Sole 104 may include a variety of different tread patterns and/or cleats depending on the intended application.

Figure 2:
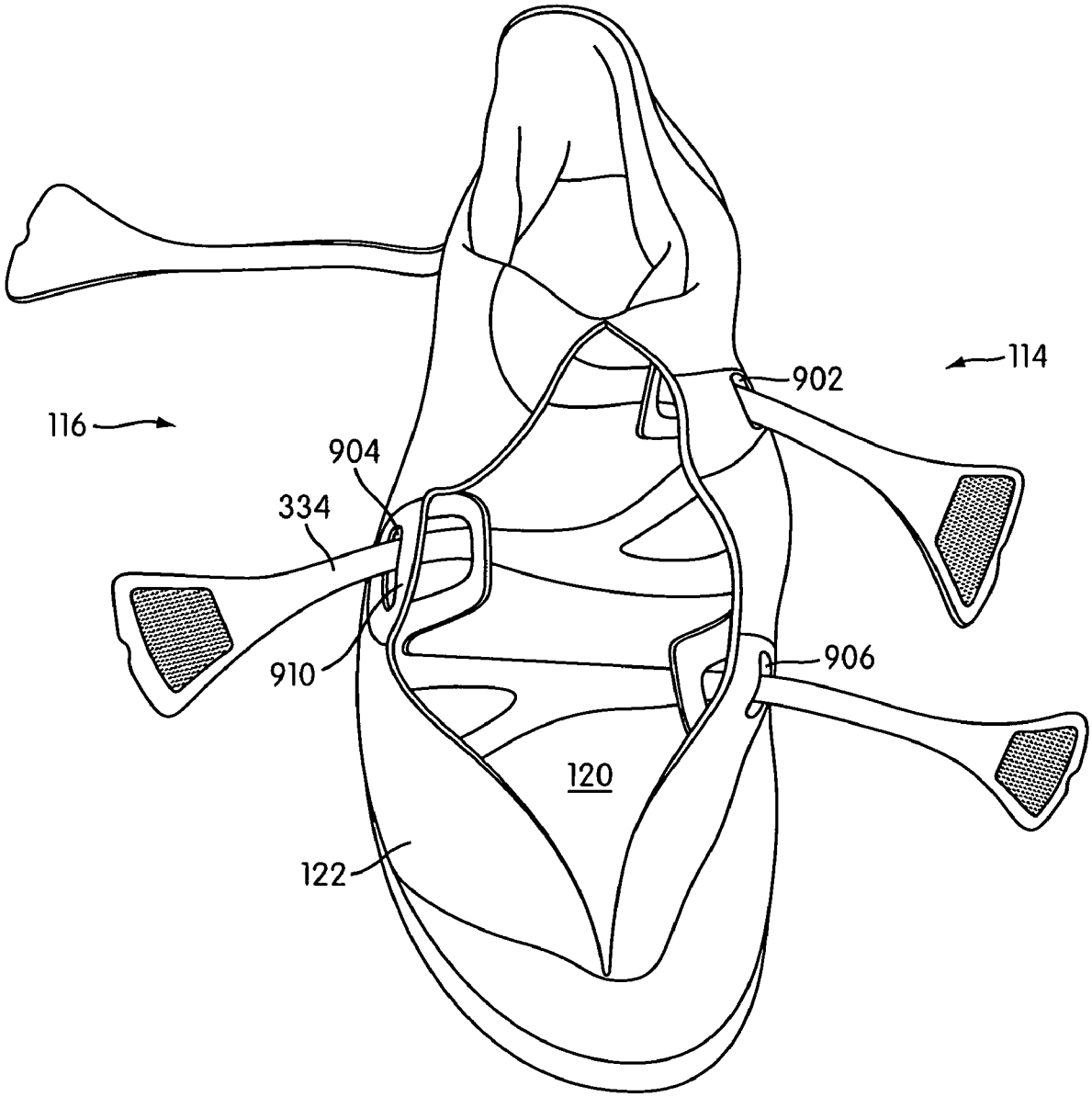
FIG. 2 is an exposed view of a preferred embodiment of an article of footwear.

Preferably, the construction of article 100 includes multiple layers. Referring to FIGS. 1 and 2, in a preferred embodiment, article 100 includes an inner layer 120 and an outer layer 122. Inner layer 120 defines a cavity 112 that is designed to receive a wear's foot. In some embodiments, inner layer 120 serves as a sockliner or a bootie. Outer layer 122 is preferably disposed further away from cavity 112 than inner layer 120.

In some embodiments, article 100 includes a fastening system. This fastening system helps article 100 to assume an expanded or open condition, where the user's foot can be inserted or removed from cavity 112 via entry hole 105, and a contracted or closed condition, where the user's foot is secured within cavity 112.

Figure 3:
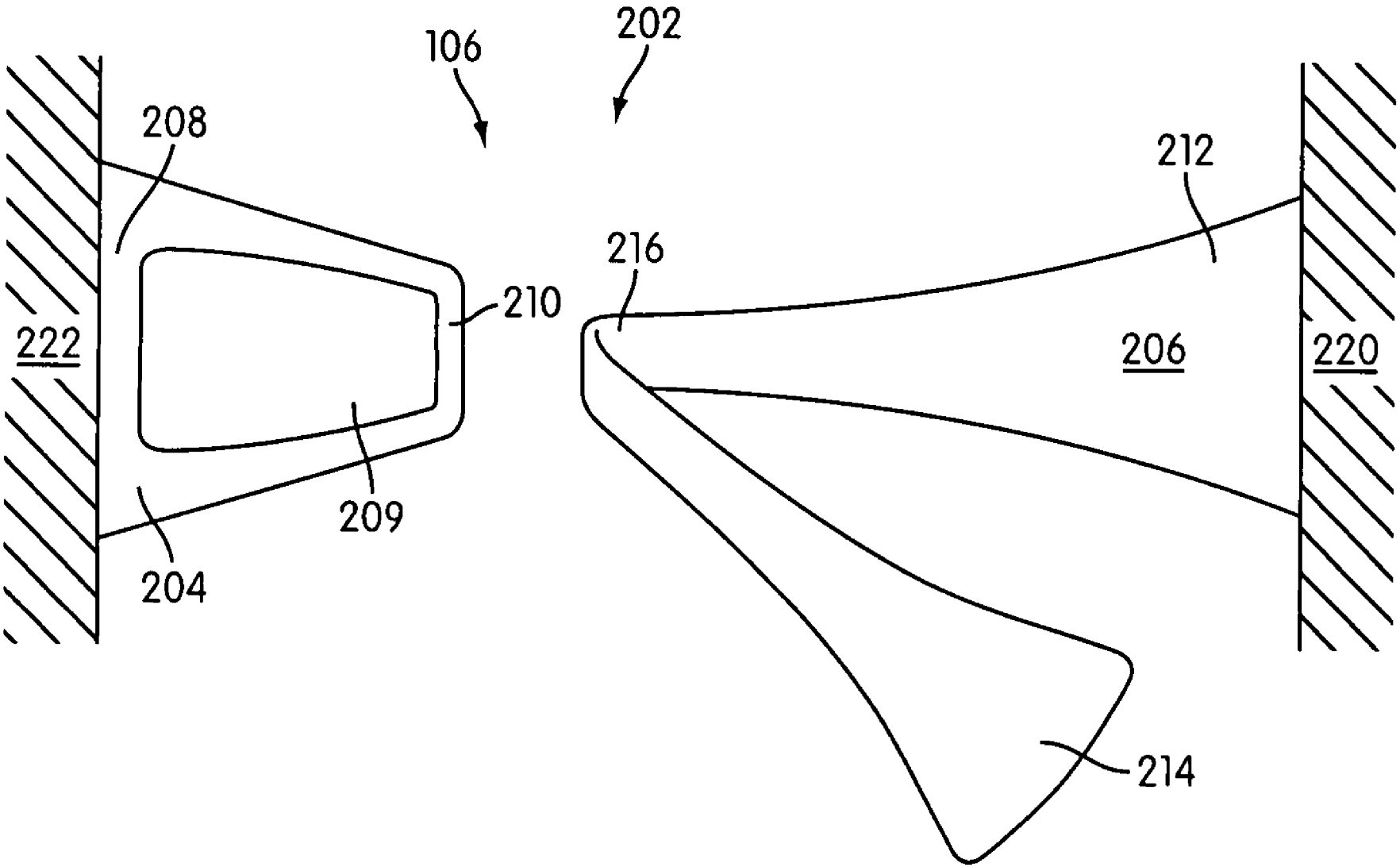
FIG. 3 is a schematic diagram of a preferred embodiment of a fastening system.

Referring to FIG. 3, which is a schematic diagram of a preferred embodiment of a fastening system 106, fastening system 106 can include one or more of the following provisions and/or features. Preferably, fastening system 106 includes at least one strap system 202. Strap system 202 preferably includes an open member 204 and a grasping member 206. Open member 204 includes a proximal end 208 and a distal end 210.

Referring to FIGS. 2 and 3, proximal end 208 is preferably associated with article 100. In some embodiments, proximal end 208 is attached to upper 102, however, in some other embodiments, proximal end 208 can also be attached to sole 104. In still other embodiments, proximal end 208 is attached to both sole 104 and upper 102. Proximal end 208 can be associated with upper 102 on a medial side 114 of article 100 or a lateral side 116 of article 100. In a preferred embodiment, proximal end 208 is attached to a strobel sock of upper 102 by using a strobel stitch.

Open member 204 preferably includes a hole 209 that is designed to interact with grasping member 206. Preferably, hole 209 is sized and shaped to interact with grasping member 206 and receive grasping member 206.

Grasping member 206 includes proximal end 212 and distal end 214. Proximal end 212 is preferably associated with article 100. In some embodiments, proximal end 212 is attached to upper 102, however, in other embodiments, proximal end 212 can also be attached to sole 104. In still other embodiments, proximal end 212 is attached to both sole 104 and upper 102. In a preferred embodiment, proximal end 212 is attached to a strobel sock of upper 102 by using a strobel stitch.

Proximal end 212 can be associated with upper 102 on a medial side 114 of article 100 or a lateral side 116 of article 100. Preferably, open strap member 204 and grasping strap member 206 are disposed on opposite sides of article 100 and correspondingly, proximal end 212 of grasping strap member 206 is associated with the opposite side of article 100 as proximal end 208 of open strap member 204.

Grasping member 206 preferably includes a central portion 216 disposed between proximal end 212 and distal end 214. Central portion 216 is designed to interact with hole 209 of open strap member 204. In a preferred embodiment, distal end 214 of grasping strap member 206 passes through hole 209 of open member 204. Eventually, central portion 216 of grasping strap member 206 enters hole 209 of open member 204. At this point, distal end 214 of grasping strap member 206 can be turned so that a loop formed by central portion 216 engages distal end 210 by using hole 209.

Figure 4:
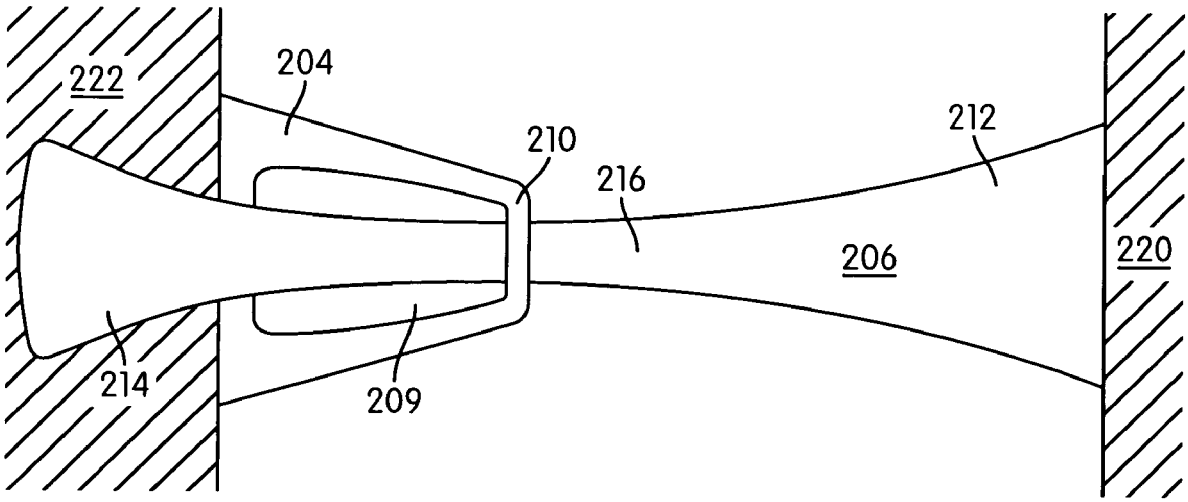
FIG. 4 is a schematic diagram of a preferred embodiment of a fastening system.
Figure 5:
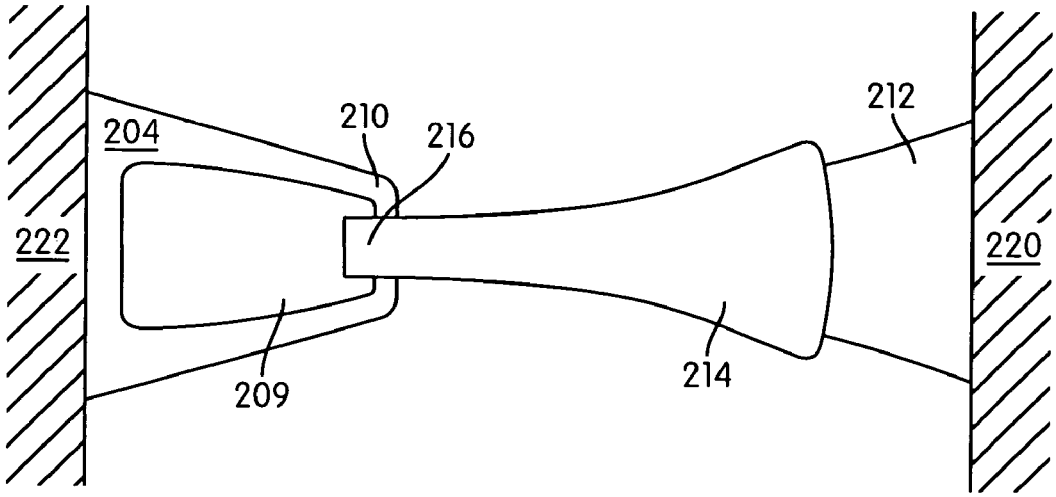
FIG. 5 is a schematic diagram of a preferred embodiment of a fastening system.

The general operation of the fastening system 106 in FIG. 3 will now be described. Referring to FIGS. 2-5, proximal end 212 of grasping member 206 is disposed on a first side 220 of article 100 and distal end 214 of grasping member 206 extends to a different side or location. Distal end 214 is threaded through an opening or hole 209 of corresponding open member 204, as shown in FIG. 4. Preferably, the grasping member 206 is made of a flexible material and grasping member 206 is then folded or bent over the distal end 210 of open member 204. At this point, the distal end 214 of grasping member 206 can be pulled towards proximal end 212 of grasping member 206 to tighten or draw together first side 220 and second side 222. Any fastener, such as a snap, magnetic catch, button, clip, pin, mechanical connection, clasp and/or a contact fastener, such as a hook and loop fastener, can be used to secure the distal end 214 of grasping member 206. As grasping member 206 closes, grasping member 206 tends to tighten upper 102 of article 100. It can be observed that changing the location where distal end 214 of grasping member 206 is secured, this can change the tension or force provided by fastening system 106.

Figure 6:
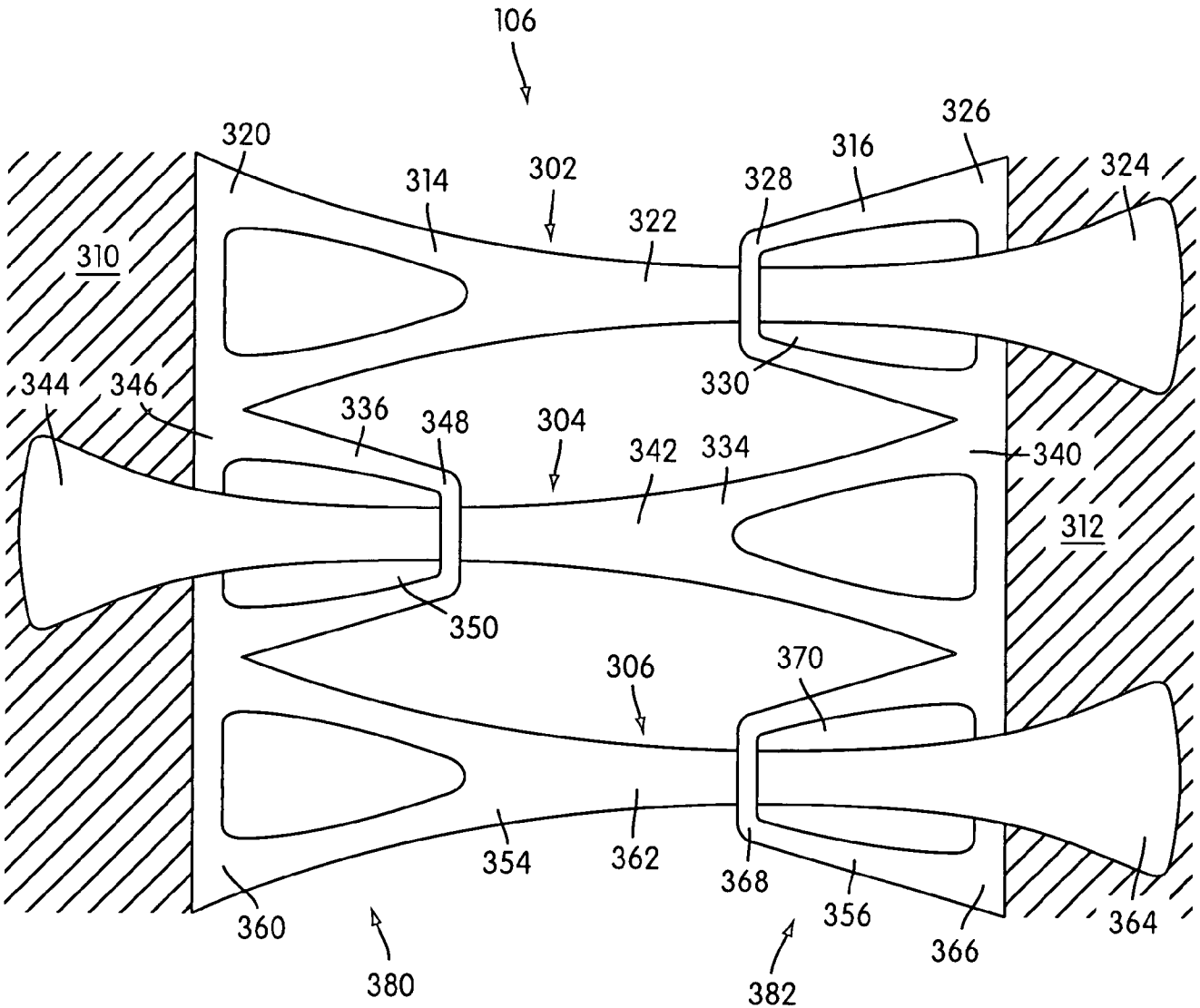
FIG. 6 is a schematic diagram of a preferred embodiment of a fastening system.

In some embodiments, fastening system 106 includes multiple strap systems. FIG. 6 is a schematic diagram of an embodiment of fastening system 106. In this embodiment, multiple strap systems are provided. Fastening system 106 includes first strap system 302, second strap system 304 and third strap system 306. While the fastening system 106 shown in FIG. 6 includes three strap systems, other embodiments of fastening systems can include more than three strap systems or less than three strap systems.

Each of the strap systems can be associated with one or more portions of article 100. In the embodiment shown in FIG. 6, each of the strap systems is associated with two portions of article 100, first side portion 310 and second side portion 312. In one embodiment, first side portion 310 can be a lateral side of article 100 and second side 312 can be a medial side of article 100. In other embodiments, the sides can be reversed, and first side portion 310 can be a medial side of article 100 and second side portion 312 can be a lateral side of article 100.

Preferably, first strap system 302 includes a first grasping member 314 and a first open member 316. First grasping member 314 preferably includes proximal portion 320, central portion 322 and distal portion 324. Proximal portion 320 is preferably associated with first side portion 310, central portion 322 is preferably designed to engage first open member 316, and distal portion 324 is disposed further away from first side portion 310 than central portion 322. First open member 316 preferably corresponds with first grasping member 314 and includes proximal portion 326 and distal portion 328.

Proximal portion 326 of first open member 316 is preferably associated with a side portion other than first side portion 310. In some cases, proximal portion 326 of first open member 316 is associated with a side portion that is opposite to the side portion associated with first grasping member 314. In the embodiment shown in FIG. 6, first grasping member 314 is associated with first side portion 310 and open member 316 is associated with second side portion 312.

First open member 316 also includes opening 330, which is preferably designed to receive first grasping member 314. In some embodiments, distal portion 328 of first open member 316 includes a flattened inner edge that generally corresponds to the shape and size of the central portion 322 of first grasping member 314. This design can help first grasping member 314 securely engage first open member 316.

Second strap system 304 can include components similar to first strap system 302. Preferably, second strap system 304 includes a second grasping member 334 and a second open member 336. Second grasping member 334 preferably includes proximal portion 340, central portion 342 and distal portion 344. Proximal portion 340 is preferably associated with second side portion 312, central portion 342 is preferably designed to engage first open member 336, and distal portion 344 is disposed further away from second side portion 312 than central portion 342. Second open member 336 preferably corresponds with second grasping member 334 and includes proximal portion 346 and distal portion 348.

Proximal portion 346 of second open member 336 is preferably associated with a side portion other than second side portion 312. In some cases, proximal portion 346 of second open member 326 is associated with a side portion that is opposite to the side portion associated with second grasping member 334. In the embodiment shown in FIG. 6, second grasping member 334 is associated with second side portion 312 and second open member 336 is associated with first side portion 310.

Second open member also includes opening 350, which is preferably designed to receive second grasping member 334. In some embodiments, distal portion 348 of second open member 336 includes a flattened inner edge that generally corresponds to the shape and size of the central portion 342 of second grasping member 334. This design can help second grasping member 334 securely engage second open member 336.

Third strap system 306 can include components similar to first strap system 302 or second strap system 304. Preferably, third strap system 306 includes a third grasping member 354 and a third open member 356. Third grasping member 354 preferably includes proximal portion 360, central portion 362 and distal portion 364. Proximal portion 360 is preferably associated with first side portion 310, central portion 362 is preferably designed to engage first open member 356, and distal portion 364 is disposed further away from first side portion 310 than central portion 362. Third open member 356 preferably corresponds with third grasping member 354 and includes proximal portion 366 and distal portion 368.

Proximal portion 366 of third open member 356 is preferably associated with a side portion other than first side portion 310. In some cases, proximal portion 366 of third open member 356 is associated with a side portion that is opposite to the side portion associated with first grasping member 354. In the embodiment shown in FIG. 6, third grasping member 354 is associated with first side portion 310 and third open member 356 is associated with second side portion 312.

Third open member 356 also includes opening 370, which is preferably designed to receive third grasping member 354. In some embodiments, distal portion 368 of third open member 356 includes a flattened inner edge that generally corresponds to the shape and size of the central portion 362 of third grasping member 354. This design can help third grasping member 354 securely engage third open member 356.

In some embodiments, it is possible to vary the number, relative size, orientation and/or form of strap systems that comprise fastening system 106. First strap system 302 can be oriented differently than second strap system 304. In some embodiments, like the one shown in FIG. 6, second strap system 304 can be oriented in an opposite direction as first strap system 302. In other words, first grasping member 314 associated with first strap system 302 can extend in a direction that is opposite to the direction of second grasping member 334 associated with second strap system 304. Some embodiments include an optional third strap system 306. If this third strap system 306 is provided, it can extend in any desired direction relative to first strap system 302 and/or second strap system 304. In a preferred embodiment, third strap system 306 extends a similar direction as first strap system 302. Given this arrangement, the three strap systems 302, 304 and 306, form an alternating pattern of strap systems.

In some embodiments, additional strap systems can be provided. If other strap systems are provided, these additional strap systems can continue the alternating pattern or they can be disposed in some other pattern. These additional strap systems can be disposed on different parts of the article of footwear and these additional strap systems can extend in different directions.

Each strap system can be separate or a strap system can be joined with one or more strap systems. Any portion of a strap system can be joined with any portion of another strap system. Strap systems can be joined for a number of different reasons. In some cases, joining strap systems can simplify manufacturing, add strength or modify the fastening characteristics of a fastening system.

In the embodiment shown in FIG. 6, an example of a joined strap system is disclosed. In this embodiment, portions of first strap system 302 are joined with portions of second strap system 304. First strap system 302 can be joined with second strap system 304 at one or several different locations. In some embodiments, it is possible to join one or more portions of first strap system 302 that are adjacent or proximate to portions of second strap system 304.

In a preferred embodiment, first grasping member 314, which is a portion of first strap system 302, can be joined with second open member 336, which is a portion of second strap system 304, in a number of different ways. Buttons, clasps, stitching, adhesives, pins, bars, joints, or any other suitable mechanical or chemical joint can be used. In some embodiments, first grasping member 314 and second open member 336 are joined because those two members are integral and formed by a continuous piece of material.

First strap system 302 can be joined with second strap system 304 in one or several different places and locations, and it is also possible to join other portions of first strap system 302 with second strap system 304. In the embodiment shown in FIG. 6, first open member 316 of first strap system 302 is joined with second grasping member 334 of second strap system 304. Preferably, proximate portion 326 of first open member 316 is joined with proximate portion 340 of second grasping member 334.

The joined arrangement of first strap system 302 and second strap system 304 results in a pair of adjacent and joined strap systems. In some embodiments, additional strap systems can be joined to a pair of connected strap systems.

In the preferred embodiment shown in FIG. 6, third strap system 306 is joined with second strap system 304. Preferably, respective adjacent portions of those two strap systems are joined. As shown in FIG. 6, proximal portion 346 of second open member 336 can be joined with proximal portion 360 of third grasping member 354. Second grasping member 334 can be joined with third open member 356. In a preferred embodiment, proximal portion 340 of second grasping member 334 can be joined with proximal portion 366 of third open member 356.

In the embodiment shown in FIG. 6, three strap systems 302, 304 and 306 are joined with one another. This arrangement results three joined strap systems. In other embodiments, additional strap systems can be provided. In these other embodiments, the various strap systems can be separated or joined together. In some cases, where strap systems are joined together, adjacent portions of all of the strap systems can be formed from a single piece of material.

In some embodiments, fastening system 106 includes a first half 380 and a second half 382. In some embodiments, each half of fastening system 106 can be formed of a single piece of material. In a preferred embodiment shown in FIG. 6, first half 380 of fastening system 106 is formed of a single piece of material and second half 382 of fastening system 106 can also be formed of a single piece of material. First half 380 can comprise first grasping member 314, second open member 336 and third grasping member 354. These components can be joined by the connections formed between proximate portion 320 of first grasping member 314, proximate portion 346 of second open member 336, and proximate portion 360 of third grasping member 354. Likewise, second half 382 can comprise first open member 316, second grasping member 334 and third open member 356. These components can be joined by the connections formed between proximate portion 326 of first open member 316, proximate portion 340 of second grasping member 334 and proximate portion 366 of third open member 356.

Figure 7:
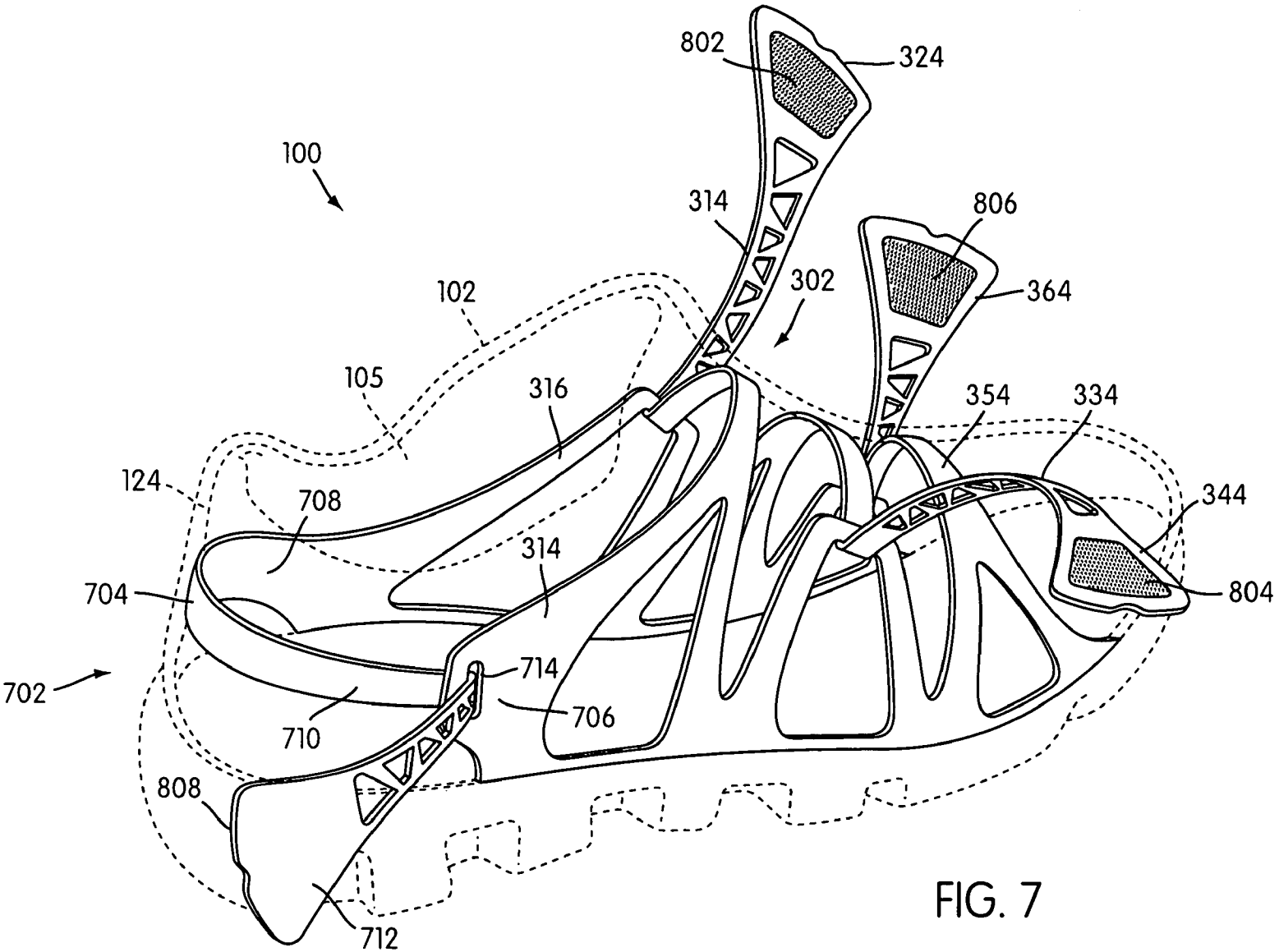
FIG. 7 is a schematic isometric view of a preferred embodiment of an article of footwear.

An exemplary embodiment that combines many of the optional features of the strap system 106 as applied to an article of footwear 100 is shown in FIG. 7. The various strap systems and their relative position on article 100 can be observed in FIG. 7.

In the preferred embodiment shown in FIG. 6, first and second strap systems 302 and 304, respectively, are adjacent. This arrangement is optional and is not necessary. It is possible to provide a different arrangement, for example, first strap system 302 can extend in a different direction than that of second strap system 304, and first strap system 302 can be disposed in a position that is different and not adjacent to second strap system 304.

Some embodiments include an optional heel cinch feature. Referring to FIGS. 1, 2 and 7-8, this feature can tighten the portion of article 100 near the heel of the wearer and can help retain the wearer's foot within article 100. In some embodiments, the heel cinch feature can be used to adjust the region of upper 102 near entry hole 105. In some cases, the heel cinch feature can apply a circumferential force or hoop stress about the rear portion 124 of article 100. The heel cinch feature can also be used to tighten or close opening 105, and snuggly fit the portion of article 100 near opening 105 closely to the wearer's ankle or leg.

In the preferred embodiment, a heel cinch device includes rear strap system 702. Rear strap system 702 is preferably similar to other strap systems associated with article 100 and includes a rear grasping member 704 and a rear open member 706. Preferably, rear grasping member 704 extends in a direction that includes a circumferential component around rear portion 124 of article 100. In some embodiments, rear grasping member 704 extends in a direction that is angled with respect to a circumferential direction.

Similar to other strap systems, rear grasping member 704 includes a proximal portion 708, a central portion 710 and a distal portion 712. Central portion 710 engages rear open member 706 and distal portion 712 is secured to article 100 so that central portion 710 grasps and holds rear open member 706.

Rear strap system 702 operates in a manner similar to other strap systems. Distal end 712 is inserted into and through rear aperture 714 of open member 706 so that central portion 710 engages and loops around open member 706. After this has been done, distal end 712 can be pulled away from open member 706 and towards proximal portion 708. This tends to draw proximal portion 708 of rear engaging member 704 towards open member 706. This action can apply a circumferential force about rear portion 124 of article 100. This action can also apply a force pressing the user's foot forward into article 100. Thus, rear strap system 702 can help retain the user's foot inside article 100 and can help to provide an improved and customized fit.

In some embodiments, rear strap system 702 can be associated with another strap system. In these embodiments where rear strap system 702 is associated with another strap system, both rear grasping member 704 and rear open member 706 can be associated with the same strap system, however, this need not be the case, and it is possible to associate rear grasping member 704 with one strap system and associate rear open member 706 with another different strap system.

Figure 8:
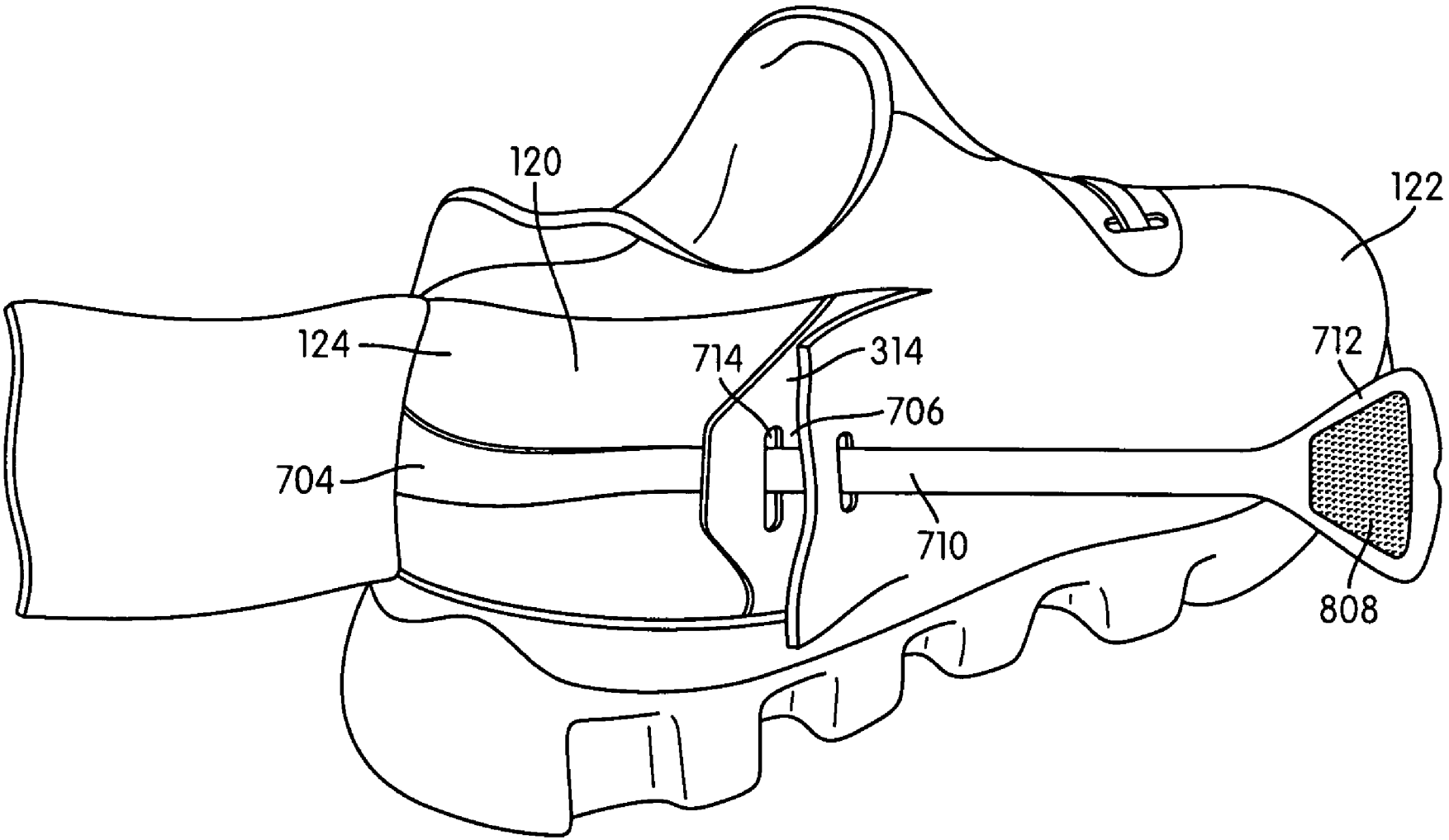
FIG. 8 is an exposed isometric view of a preferred embodiment of an article of footwear.

In a preferred embodiment shown in FIGS. 7 and 8, both elements of rear strap system 702 are associated with the same, adjacent strap system. As shown in FIGS. 7 and 8, proximal portion 708 of rear grasping member 704 is associated an adjacent open member. In an exemplary embodiment, the adjacent open member can be first open member 316 of first strap system 302. This association can be observed in FIG. 7. Like other strap systems, rear strap system 702 and first strap system 302 can be associated in many ways. In some embodiments, rear strap system 702 and first strap system 302 are associated by being joined together. Although rear strap system 702 and first strap system 302 can be joined in many ways, in an exemplary embodiment, the two strap systems 702 and 302, are joined by having portions that are integrally formed. In an exemplary embodiment, proximal portion 708 of rear grasping member 704 can be formed integrally with first open member 316. Preferably, rear open member 706 is also associated with an adjacent grasping member. In an exemplary embodiment, rear open member 706 is associated with first grasping member 314. In some cases, rear open member 706 is formed integrally with first grasping member 314 by providing aperture 714 in first grasping member 314, as shown in FIG. 7.

In some embodiments, article 100 includes an outer layer and portions of the fastening system are designed to extend through the outer layer. Referring to FIG. 2, which is an exposed or cut away view of a preferred embodiment, article 100 can include an inner layer 120 and an outer layer 122. This arrangement can also be observed in FIG. 9, which is an exploded isometric view of a preferred embodiment. Inner layer 120 is disposed closer to a wearer's foot than outer layer 122. Preferably, inner layer 120 is made of a flexible material that can closely conform to a wearer's foot. As shown in FIG. 2, portions of fastening system 106 can be disposed between inner layer 120 and outer layer 122. Preferably, a majority of fastening system 106 is disposed within outer layer 122 and is covered by outer layer 122. In some embodiments, these covered portions are not visible from the outside.

Exterior holes can also be provided so that portions of fastening system 106 can extend through outer layer 122.

Preferably, distal ends of the grasping members extend through these exterior holes, and a hole is preferably provided for each grasping member.

Figure 9:
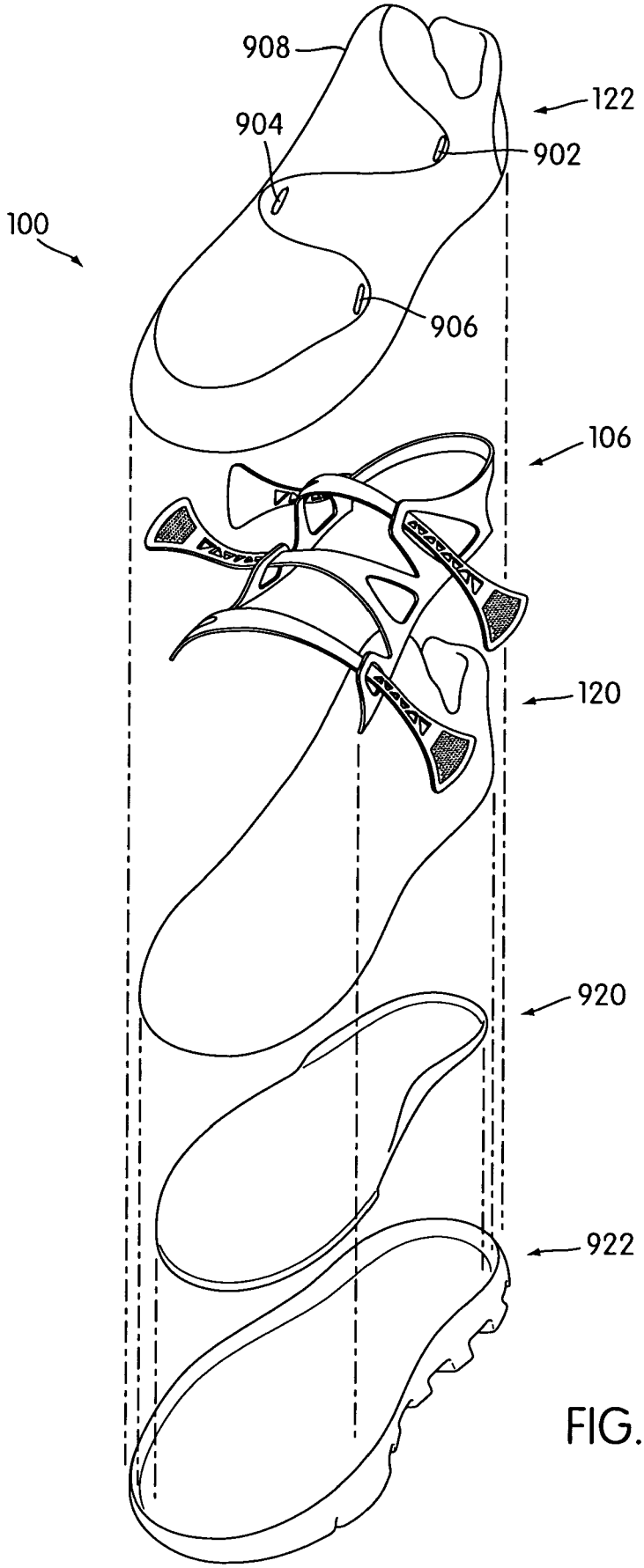
FIG. 9 is an exploded view of a preferred embodiment of an article of footwear.

In a preferred embodiment shown in FIGS. 1, 2 and 9, article 100 includes four strap systems with four grasping members. Thus, outer layer 122 preferably includes four corresponding holes for each of the four grasping members. Preferably, outer layer 122 includes first hole 902, second hole 904, third hole 906 and fourth hole 908.

Preferably, each hole is located so that the corresponding grasping member can be threaded through the hole after it has been threaded through its respective open member. It can also be observed that, in some embodiments, the exterior hole corresponds with a respective open member, and more particularly, with the opening of the respective open member. In some exemplary embodiments, the exterior hole is aligned with the opening of the respective open member.

Turning to the preferred embodiment shown in the Figures, first exterior hole 902 is preferably designed to correspond with first strap system 302. First exterior hole 902 is located proximate first open member 316. Preferably, first exterior hole 902 is located near opening 330 of first open member 316, and in an exemplary embodiment, first exterior hole 902 is generally aligned with opening 330 of first open member 316. With this configuration, first grasping member 314 can extend through opening 330 of first open member 316, and then extend through first exterior hole 902 disposed in outer layer 122. This allows first grasping member 314 to protrude out of outer layer 122.

The second exterior hole 904, third exterior hole 906 and fourth exterior hole 908 are preferably configured in similar ways, and allow their respective grasping member to protrude out of outer layer 122. Therefore, second exterior hole 904 can be designed to accommodate second grasping member 334, third exterior hole 906 can be designed to accommodate third grasping member 354, and fourth exterior hole 908 can be designed to accommodate rear grasping member 704.

Second exterior hole 904 can include second exterior engaging portion 910 (see FIG. 2), which is designed to interact with second grasping member 334. Second exterior engaging portion 910 can be designed to accommodate the shape of second grasping member 334 and can be made of a stiffer or more durable material than other portions of outer layer 122. In the preferred embodiment shown in the Figures, second exterior engaging portion 910 includes a generally straight or flattened portion that is designed to accommodate the folded bend of second grasping member 334. The other exterior holes can also include features similar to those provided by second exterior engaging portion 910. In some embodiments, several or all of the exterior holes include exterior engaging portions.

This arrangement allows a grasping member to grasp and hold a corresponding open member as well as a portion of outer layer 122. In some embodiments, outer layer 122 is very flexible and simply provides an outer cover for article 100. In other words, outer layer 122 is pliable and generally does not provide a significant constraining force on the user's foot. However, in other embodiments, outer layer 122 is flexible but also structural, and provides a constraining force on the wearer's foot. In these embodiments, both the strap system or systems and outer layer 122 provide a constraining force on the user's foot and both are used to help secure article 100 to the wearer's foot.

It is possible to manufacture or assemble article 100 in a number of different ways. In some embodiments, inner layer 120, fastening system 106 and outer layer 122 are attached to strobel sock 920. In a preferred embodiment, inner layer 120, fastening system 106 and outer layer 122 are all attached to strobel sock 920 by a strobel stitch. After these items have been assembled, the items can be attached to tooling 922 in known ways. In some cases, tooling 922 is also referred to as a sole.

In embodiments where portions of a fastening system extend through outer layer 122, it is possible to provide provisions where portions of the exposed fastening system can engage or interact with the outer layer 122. In some embodiments, a fastener or connector associated with the exposed portions of the fastening system engages outer surface 122.

Preferably, a releasable fastener is used, and in an exemplary embodiment, a hook and loop fastener is used. Hook and loop fasteners are sometimes referred to as Velcro (the term "Velcro" used throughout this specification is a registered Trademark), which is one type of hook and loop fastener. In the embodiment shown in FIG. 7, first grasping member 314 includes a first fastener 802. First fastener 802 can be disposed in any convenient location on first grasping member 314. However, in a preferred embodiment, first fastener 802 is disposed near or on distal portion 324 of first grasping member 314.

In some embodiments, several or all of the grasping members associated with article 100 include some form of fastener. In a preferred embodiment, all of the grasping members include similar fasteners. In the embodiment shown in the FIG. 7, second, third and fourth grasping members also preferably include a fastener disposed on or near their respective distal portions.

Second grasping member 334 preferably includes a second fastener 804 disposed on or near the distal portion 344 of second grasping member 334. Third grasping member 354 preferably includes a third fastener 806 disposed on or near the distal portion 364 of third grasping member 354. And finally, rear grasping member 704 preferably includes a fourth fastener 808 (see FIG. 8) disposed on or near the distal portion 712 of rear grasping member 704.

Some embodiments include provisions that permit the fasteners disposed on a grasping member to attach to outer layer 122. In some embodiments, outer layer 122 is capable of holding or retaining the fasteners. In a preferred embodiment, the fasteners disposed on the grasping members include a hook and loop material and outer layer 122 includes a cooperating hook and loop material. In an exemplary embodiment, outer layer 122 is made of a hook and loop compatible material that is capable of cooperating with the hook and loop material of the fasteners disposed on the grasping members.

A hook and loop compatible material is any material that can securely engage a corresponding hook and loop material or any other releasable fastening system. Hook and loop compatible materials can securely engage either the hook or loop surface. In the embodiments shown in FIGS. 1 and 2, upper 102 is made of a hook and loop compatible material. In one embodiment, substantially all of the material used to form outer surface 122 is made from a hook and loop compatible material. While outer surface 122 can be formed of any hook and loop compatible material, in a preferred embodiment, outer surface 122 is formed of a Velcro compatible material that is configured to securely engage the hook side of a Velcro fastener. In other words, the material used to form outer surface 122 acts in a manner similar to the loop side of a conventional Velcro fastener.

Outer surface 122 can be made of a variety of different materials formed in a variety of different ways. Preferably, outer surface 122 is made of a soft flexible material. In some embodiments, outer surface 122 is stretchable in one or more directions. Outer surface 122 can also be woven.

Figure 10:
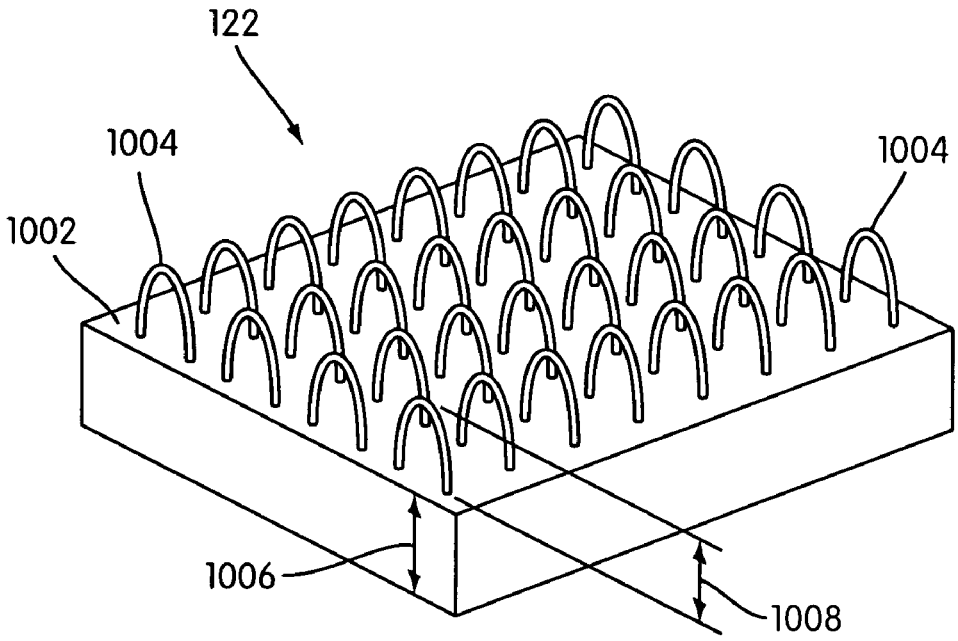
FIG. 10 is an enlarged isometric view of a preferred embodiment of an outer layer material.
Figure 11:
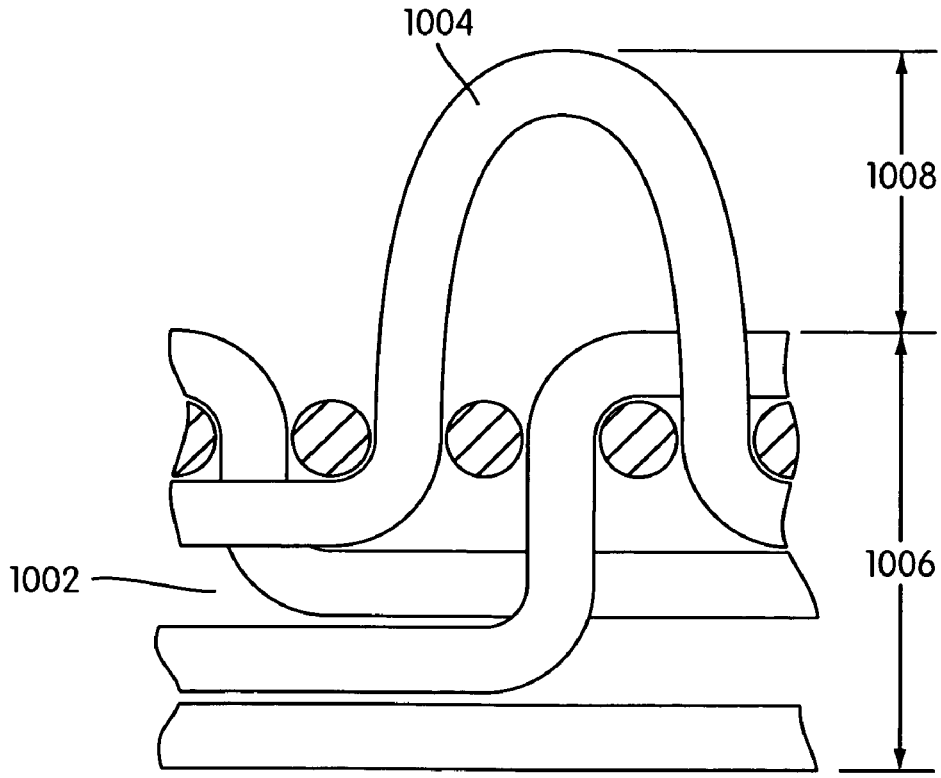
FIG. 11 is a separated elevational view of a preferred embodiment of an outer layer material.

FIG. 10 is an enlarged schematic diagram of outer surface 122. Outer surface 122 includes base portion 1002 and a plurality of extending loops 1004. Base portion 1002 has a thickness 1006, and in some embodiments, the height 1008 of loops 1004 above base 1002 is greater than the thickness 1006 of base 1002. In other embodiments, the height 1008 of loops 1004 is generally equal to the thickness 1006 of base 1002. However, in preferred embodiments, the height 1008 of the loops 1004 is less than the thickness 1006 of base 1002, as shown in FIG. 11.

In an exemplary embodiment, outer surface 122 is made of a brushing pile fabric that includes the following characteristics. L 51001N; 290 gm/per yard in 54" width; and 100% 70D Nylon 6. In another embodiment, outer surface 122 is made of a brushing pile fabric that includes the following characteristics: L 51002N; 220 gm/per yard in 54" width; and 100% 50D Nylon 6. Either of these materials or fabrics can be made by knitting. In some embodiments, it is possible to make these fabrics by knitting with a normal Warp Knitting (Tricot) machine.

An article of footwear 100 using some or all of the concepts disclosed above provides an adjustable fastening system that can help to create a comfortable and customized fit. Each of the fastening members are capable of attaching to substantially the entire outer surface of outer layer 122. This placement flexibility allows the wearer to precisely control the fastening characteristics of each fastening member.

Figure 12:
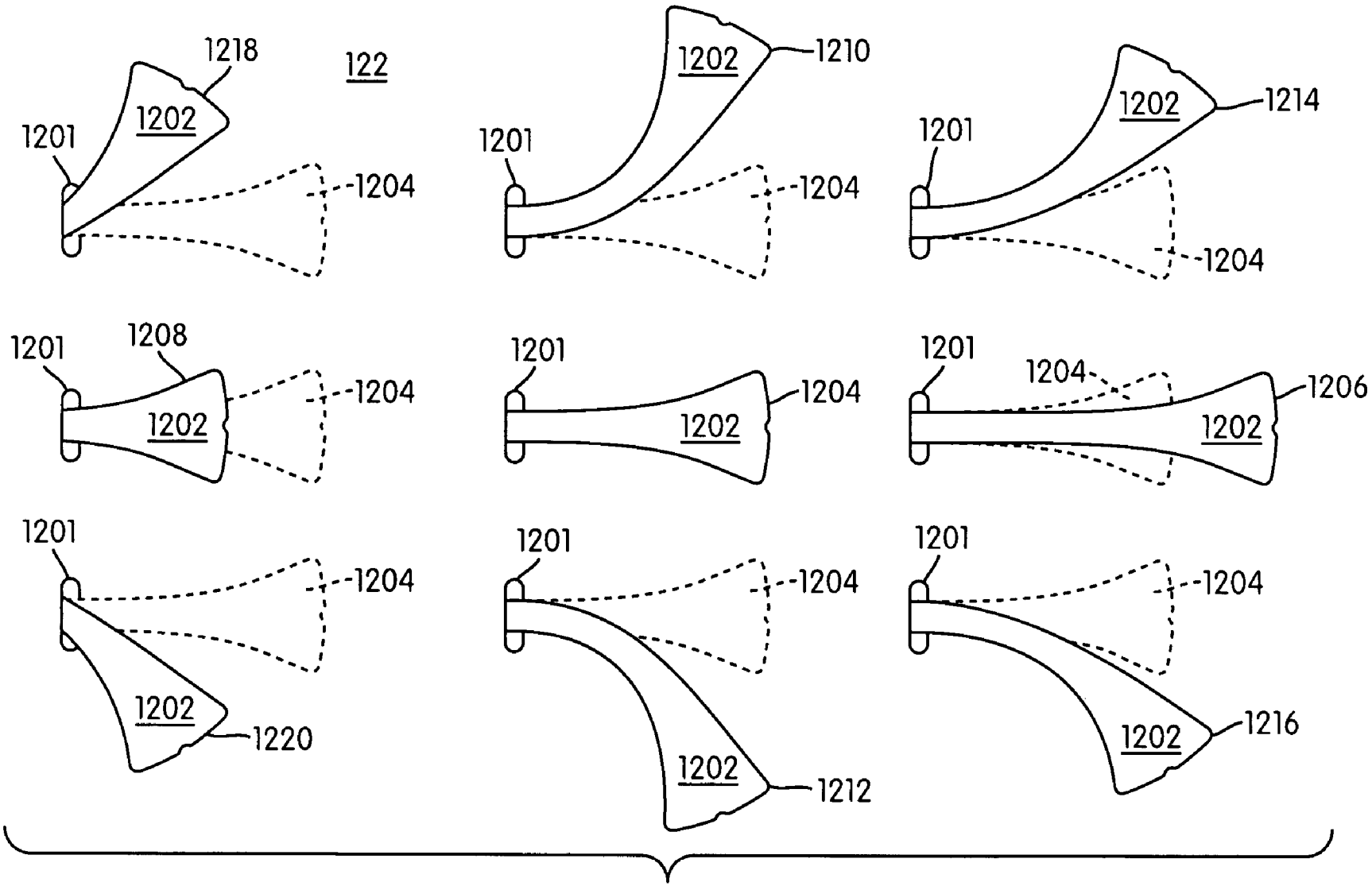
FIG. 12 is a schematic diagram of a preferred embodiment of possible placement positions of a grasping member.

Referring to FIG. 12, which is a schematic diagram of a preferred embodiment of example placement positions of a fastening member, it can be observed that article 100 provides a variety of placement options for grasping member 1202. Grasping member 1202 is representative of other grasping members associated with fastening system 106, and can be similar in some ways to those grasping members. In the embodiment shown in FIG. 12, grasping member 1202 includes a fastener disposed on its underside, the side facing the page.

In some cases, grasping member 1202 can be placed in a first position 1204. In this first position 1204, fasteners disposed on grasping member 1202 engage a cooperating surface. In some embodiments, outer surface 122 is made of a material that can serve as a cooperating surface. Because outer surface 122 provides an expansive cooperating surface for grasping member 1202, grasping member 1202 can be attached to outer surface 122 in a variety of different positions.

Using first position 1204 as a reference position, it is possible to attach grasping member 1202 in a second position 1206 that is further away from exterior hole 1201 than first position 1204. In this position, grasping member 1202 can provide additional tension to its associated strap system. It is also possible to attach grasping system 1202 to outer layer 122 in a third position 1208. This third position 1208 is closer to exterior hole 1201 than first position 1204. In this third position, the amount of tension provided by grasping member 1202 can be reduced. This position can also be used to accommodate a larger local portion of the wearer's foot.

Because of the expansive cooperating surface offered by outer layer 122, grasping member 1202 can be placed off-axis and in a position that is angled with respect to first position 1204. In some embodiments, it is possible to place grasping member 1202 in a fourth position 1210 that is angled counter clockwise with respect to first position 1204. Grasping member 1202 can also be attached to outer surface 122 in a fifth position 1212 that is angled clockwise with respect to first position 1204. These angled positions can be used to alter the tension characteristics, including tension angle and to change the direction or geometry of the hoop stress generated by the strap system associated with grasping member 1202.

It is also possible, in some embodiments, to combine axial adjustment (generally, the amount grasping member 1202 is pulled away from exterior hole 1201), as shown in second position 1206 and third position 1208 with angled adjustment, as shown in fourth position 1210 and fifth position 1212. Grasping member 1202 can be placed in sixth position 1214. In this position, grasping member 1202 is pulled further away from exterior hole 1201 than first position 1204, and grasping member 1202 is also angled counter clockwise. Grasping member 1202 can be placed in seventh position 1216. In this position, grasping member 1202 is pulled further away from exterior hole 1201 than first position 1204, and grasping member 1202 is also angled clockwise. Grasping member 1202 can also be placed in any angled position between sixth position 1214 and seventh position 1216. Grasping member 1202 can also be placed beyond the sixth 1214 and seventh 1216 positions both in terms of distance from exterior hole 1201 and angle.

Grasping member 1202 can also assume eighth position 1218 and ninth position 1220. In these positions, grasping member 1202 is located closer to exterior hole 1201 than first position 1204 and grasping member 1202 and is also angled. In eighth position 1218, grasping member 1202 is angled counter clockwise with respect to first position 1204 and in ninth position 1220, grasping member 1202 is angled clockwise with respect to first position 1204.

It should be understood that the nine positions shown in FIG. 12 are only examples, and grasping member 1202 can assume any position in between those nine positions and any position beyond those nine positions. FIG. 12 serves to demonstrate the placement flexibility offered by grasping member 1202 and outer surface 122. In article 100, any of the grasping members can be placed with the variability shown in FIG. 12. This placement flexibility allows the wearer to custom fit article 100. The variable placement of the grasping members allows article 100 to accommodate a wide variety of foot sizes and shapes and allows the wearer to customize the fit for a particular application or sport.

The construction of grasping member 1202 can be varied to suit different conditions and/or uses. In some cases, grasping member 1202 can be made of a continuous or monolithic material and in other cases, grasping member 1202 can include perforations or webbing. An example of a monolithic grasping member can be seen in FIG. 1 and an example of a webbed or perforated grasping member can be seen in FIG. 7. In some cases, different grasping members of a strap system will have different constructions with one or more grasping members being monolithic while others are webbed. In some cases, all of the grasping members of a strap system will have the same construction. Again, the construction of the grasping member can be varied or selected depending on a number of different factors, including weight, flexibility, styling and other factors.

Each of the various components, steps or features disclosed can be used alone or in combination with other components, steps or features. These other components, steps or features can be known or can be components, steps or features that are disclosed above. Each of the components, steps or features can be considered discrete and independent building blocks. In some cases, combinations of the components, steps or features can be considered a discrete unit.

While various embodiments of the invention have been described, it will be apparent to those of ordinary skill in the art that may more embodiments and implementations are possible that are within the scope of the invention. Accordingly, the invention is not to be restricted except as specifically recited in the following claims and their equivalents.

What is claimed is:

1. An article of footwear, comprising:

a sole;

an upper including a first side, a second side, an upper portion including an opening configured to receive a foot, the upper being connected to the sole;

a strap associated with the first side and extending over the upper portion;

the strap having an inner portion facing towards the article of footwear and an outer portion facing away from the article of footwear;

the strap configured to engage the second side; the strap including a first contact fastener material disposed on the inner portion;

the upper including an inner layer and an outer layer, the strap having a portion disposed between the inner layer and the outer layer, the outer layer substantially covering the upper and being made of a second contact fastener material;

wherein the first contact fastener is configured to engage the second contact fastener; and wherein the outer layer of the upper includes an aperture aligned with an aperture in a first strap member, the aperture in the upper allowing a second strap member to emerge out of the outer layer after being threaded through the aperture in the second strap member.

2. The article of footwear according to claim 1, wherein the first side is a lateral side and the second side is a medial side.

3. The article of footwear according to claim 1, wherein the first side is a medial side and the second side is a lateral side.

4. The article of footwear according to claim 1, wherein a majority of the strap is disposed underneath the outer layer.

5. The article of footwear according to claim 4, wherein a portion of the strap is disposed above the outer layer.

6. The article of footwear according to claim 1, wherein the strap comprises a grasping member and an associated open member.

7. The article of footwear according to claim 6, wherein the grasping member engages the open member and is threaded through the aperture in an outer layer.

8. An article of footwear, comprising:

a sole;

an upper including an opening configured to receive a foot, the upper being connected to the sole;

at least one strap having an inner portion facing towards the article of footwear and an outer portion facing away from the article of footwear;

the strap including a portion positioned between an inner layer and an outer layer of the upper and configured to engage a portion of the upper;

wherein the strap includes a first contact fastening member; and wherein the upper includes a second contact fastening member that cooperates with the first contact fastening member; and wherein the upper includes an aperture allowing the strap to emerge out of the upper after the strap is threaded through an aperture in another portion of a fastening system, the aperture in the fastening system portion being aligned with the aperture in the upper.

9. The article of footwear according to claim 8, wherein the upper includes an outer layer made of the second contact fastening member and wherein the strap is configured to engage the outer layer.

10. The article of footwear according to claim 9, wherein the strap is configured to be attached to the outer layer at an attached position.

11. The article of footwear according to claim 10, wherein the attached position can be adjusted in a first direction and also adjusted in a second direction, where the first direction is angled from the second direction.

12. The article of footwear according to claim 10, wherein the attached position can be varied away from the aperture in the upper.

13. The article of footwear according to claim 12, wherein the attached position can be angled with respect to the aperture.

14. The article of footwear according to claim 8, wherein the second contact fastening member is larger in length and width than the first contact fastening member.

15. An article of footwear, comprising:

a sole;

an upper including an opening configured to receive a foot connected to the sole;

the upper including an outer layer being made of a material, and also including an inner layer disposed inwards of the outer layer;

a strap system disposed between the inner layer and the outer layer;

wherein the material is a contact fastener; and wherein the outer layer of the upper includes a first hole aligned with an aperture in a first portion of the strap system, the strap system including a first portion and a second portion, the second portion of the strap system being threaded through the aperture in the first portion, the first hole allowing second portion of the strap system to emerge out of the outer layer after engaging the first portion of the strap system.

16. The article of footwear according to claim 15, wherein the material is a woven flexible fabric.

17. The article of footwear according to claim 15, wherein the material is compatible with a hook and loop fastener.

18. The article of footwear according to claim 15, wherein the material is configured to act as a loop side of a hook and loop fastener.

19. The article of footwear according to claim 15, wherein the material is compatible with a Velcro fastener.

20. An article of footwear comprising:

a sole;

an upper connected to the sole including an opening configured to receive a foot, an inner layer and an outer layer, a fastening system disposed between the inner layer and the outer layer;

the fastening system having a first side and a second side and including a first strap system, the first strap system including a first grasping member and a first open member, wherein the first grasping member is threaded through an aperture in the first open member and a central portion of the first grasping member bends around the first open member; and wherein the outer layer of the upper includes a first hole aligned with the first open member, the first hole allowing the grasping member to emerge out of the outer layer after bending around the first open member.

21. The article of footwear according to claim 20, wherein the first grasping member is associated with the first side and the first open member is associated with the second side.

22. The article of footwear according to claim 21, wherein the fastening system includes a second strap system having a second grasping member and a second open member.

23. The article of footwear according to claim 22, wherein the second grasping member is associated with the second side and the second open member is associated with the first side.

24. The article of footwear according to claim 23, wherein the fastening system includes a third strap system having a third grasping member associated with the first side and a third open member associated with the second side; and wherein the second strap system is disposed between the first strap system and the third strap system to provide an alternating pattern of strap systems.

25. The article of footwear according to claim 24, wherein the second open member is connected to the third grasping member.

26. The article of footwear according to claim 25, wherein the second grasping member is connected to the third open member.

27. The article of footwear according to claim 24, wherein the second open member is connected to the first grasping member and the third grasping member.

28. The article of footwear according to claim 24, wherein the second grasping member is connected to the first open member and the third open member.

29. The article of footwear according to claim 22, wherein the first grasping member is connected to the second open member.

30. The article of footwear according to claim 22, wherein the first open member is connected to the second grasping member.

31. The article of footwear according to claim 20, wherein the first strap system is connected to a rear strap system that is disposed about a rear portion of the article of footwear.

32. The article of footwear according to claim 31, wherein the rear strap system includes a rear grasping member and a rear open member.

33. The article of footwear according to claim 32, wherein the rear grasping member is integrally formed with the first strap system and wherein the rear open member is an aperture formed in the first strap system.

34. An article of footwear, comprising:

a sole;

an upper connected to the sole including an opening configured to receive a foot, an inner layer and an outer layer substantially covering a rear portion of the upper, a fastening system disposed between the inner layer and the outer layer;

the fastening system having a rear strap system disposed about the rear portion of the article of footwear and configured to provide a heel cinch; the rear strap system having a portion disposed between the inner layer and the outer layer and a portion disposed outward of the outer layer; and wherein the outer layer of the upper includes a rear hole aligned with an aperture in a rear open member of the rear strap system, the rear open member being positioned between the inner layer and the outer layer, and wherein the rear grasping member is threaded through an aperture in the rear open member, the rear hole allowing a rear grasping member to emerge out of the outer layer after bending around the rear open member.

35. The article of footwear according to claim 34, wherein the rear grasping member emerges from the rear hole formed on the outer layer and attaches to the outer layer.

36. The article of footwear according to claim 35, wherein the rear grasping member includes a first contact fastener and the outer layer is formed of a second contact fastener configured to cooperate with the first contact fastener.

37. The article of footwear according to claim 35, wherein the rear grasping member extends circumferentially about the rear portion of the article of footwear and applies a hoop stress about the rear portion.

38. The article of footwear according to claim 35, wherein the rear grasping member can be attached to the outer layer in a first location and a second location, wherein the second location is horizontally and vertically spaced from the first location.

* * * * *